US007399940B1

(12) United States Patent
Tseng

(10) Patent No.: US 7,399,940 B1
(45) Date of Patent: Jul. 15, 2008

(54) ZIPPER SWITCH FOR THE DC MOTOR OF A CEILING FAN

(76) Inventor: Ming-chi Tseng, No. 18, Jhensing E. St., Wufong Township, Taichung County 413 (TW)

( * ) Notice: Subject to any disclaimer, the term of this patent is extended or adjusted under 35 U.S.C. 154(b) by 0 days.

(21) Appl. No.: 11/882,142

(22) Filed: Jul. 31, 2007

(51) Int. Cl.
*H01H 17/18* (2006.01)

(52) U.S. Cl. ..... 200/544; 200/51.11

(58) Field of Classification Search ..... 200/11 R–11 H, 200/543–546, 329–331, 537, 51.15, 413, 200/420; 318/778, 779, 794; 362/394, 395; 315/362; 439/753, 703, 731, 666
See application file for complete search history.

(56) References Cited

U.S. PATENT DOCUMENTS 1,053,697 A * 2/1913 Barr ..... 200/420
1,158,428 A * 11/1915 Barr ..... 200/420
4,766,277 A * 8/1988 Bigelow, Jr. ..... 200/293
5,252,794 A * 10/1993 Tseng ..... 200/51.15
5,278,366 A * 1/1994 Fleischhauer ..... 200/51.15
6,921,874 B2 * 7/2005 Tseng ..... 200/544
6,946,815 B1 * 9/2005 Hao et al. ..... 318/772

* cited by examiner

*Primary Examiner*—Michael A Friedhofer
(74) *Attorney, Agent, or Firm*—Rosenberg, Klein & Lee

(57) ABSTRACT

A zipper switch for the DC motor of a ceiling fan has an upper shell and a lower shell. The upper shell is pivotally disposed with an activating disk, an elastic element, and a zipper connected with the activating disk. One side of the activating disk has a connecting part that is disposed with a metal plate. Contacts are formed on both sides of the connecting part. The lower shell accommodates the connecting part. A conductive elastic plate is provided on both sides of the metal plate contacts. The rotation of the activating disk enables the contacts of the metal plate to have instantaneous contacts with the corresponding conductive elastic plates that are connected with wires. An instantaneous electrical current is thus produced.

3 Claims, 4 Drawing Sheets

ZIPPER SWITCH FOR THE DC MOTOR OF A CEILING FAN

BACKGROUND OF THE INVENTION

1. Field of Invention

The invention relates to a zipper switch for the DC motor of a ceiling fan and, in particular, to a zipper switch that switches on a circuit and provides an instantaneous electrical current.

2. Related Art

For an AC ceiling fan, a common trigger method is implemented by continuously providing electricity to start the fan or change the rotation speed thereof. As shown in FIGS. 4 to 6, a zipper switch 9 that can continuously provide electricity in the prior art consists mainly of an upper shell 91 and a lower shell 92 connected together. The upper shell 91 has an activating disk 911, a zipper 912, a torque spring 913, and a pressing cover 914. The activating disk 911 and the torque spring 913 are pivotally disposed at the center of the upper shell. The zipper 912 is connected to the activating disk 911. The center on one side of the activating disk 911 is protruded with four pushing parts 9111 with a slant surface. By pulling the zipper 912, one rotates the activating disk 911 with respect to the center of the upper shell 91. The pushing parts 9111 are driven to rotate along the same direction and advance by the distance of one pushing part. On the other hand, when the zipper 912 is released, the torque spring 913 makes the pushing parts 9111 rotate in the opposite direction and back by the distance of one pushing part.

The above-mentioned lower shell 92 has a rotating block 921 and two conductive elastic plates 922. The rotating block 921 is pivotally disposed at the center of the lower shell 921. It has a conductive elastic plate 9211 to form contact points on both sides. The outer side of the rotating block 921 is disposed using four passive parts 9212 corresponding to the pushing parts 9111. The conductive elastic plate 922 is disposed in the vicinity of the rotating block 921. Therefore, the pushing force produced when the pushing parts 9111 rotate forward can push the passive parts 9212, so that the passive parts 9212 rotate one quarter of the circumference along one direction. After first puling and releasing the zipper 912, it is switched a connect mode, as shown in FIG. 5. When the zipper 912 is pulled and released again, it is switched to a disconnect mode, as shown in FIG. 6. This enables the two contact points of the conductive elastic plate 9211 to switch between connect and disconnect modes with the conductive elastic plate 922, producing the On and Off effects.

However, the zipper switch can only be applied to an AC motor. For a DC motor, the trigger method has to be achieved using an instantaneous current. The conventional zipper switch cannot accomplish this goal.

SUMMARY OF THE INVENTION

An objective of the invention is to solve the above-mentioned problems and to provide a zipper switch for the DC motor of a ceiling fan. By disposing symmetric and conductive metal plates on a connecting part of the activating disk, the rotation of the pulled activating disk enables the metal plate to have an instantaneous contact with the conductive elastic plates connected with wires. This achieves the production of an instantaneous electrical current.

In accord with the above objective, the invention includes: an upper shell and a lower shell. The upper shell is pivotally disposed with an activating disk, an elastic element, and a zipper connected to the activating disk. One end of the elastic element urges against the activating disk, and the other end against the upper shell. The activating disk can be pulled by the zipper to rotate along one direction, but pushed by the elastic element due to its elastic force to rotate in the opposite direction. The center on one side of the activating disk has a connecting part disposed with a metal plate, so that the metal plate forms contacts on both sides of the connecting part for the conduction of an electrical current.

The lower shell is connected with the upper shell. The central part of the lower shell accommodates the connecting part. In the vicinity of the contacts of the metal plate are provided with two conductive elastic plates, so that instantaneous contacts are formed as the activating disk rotates.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
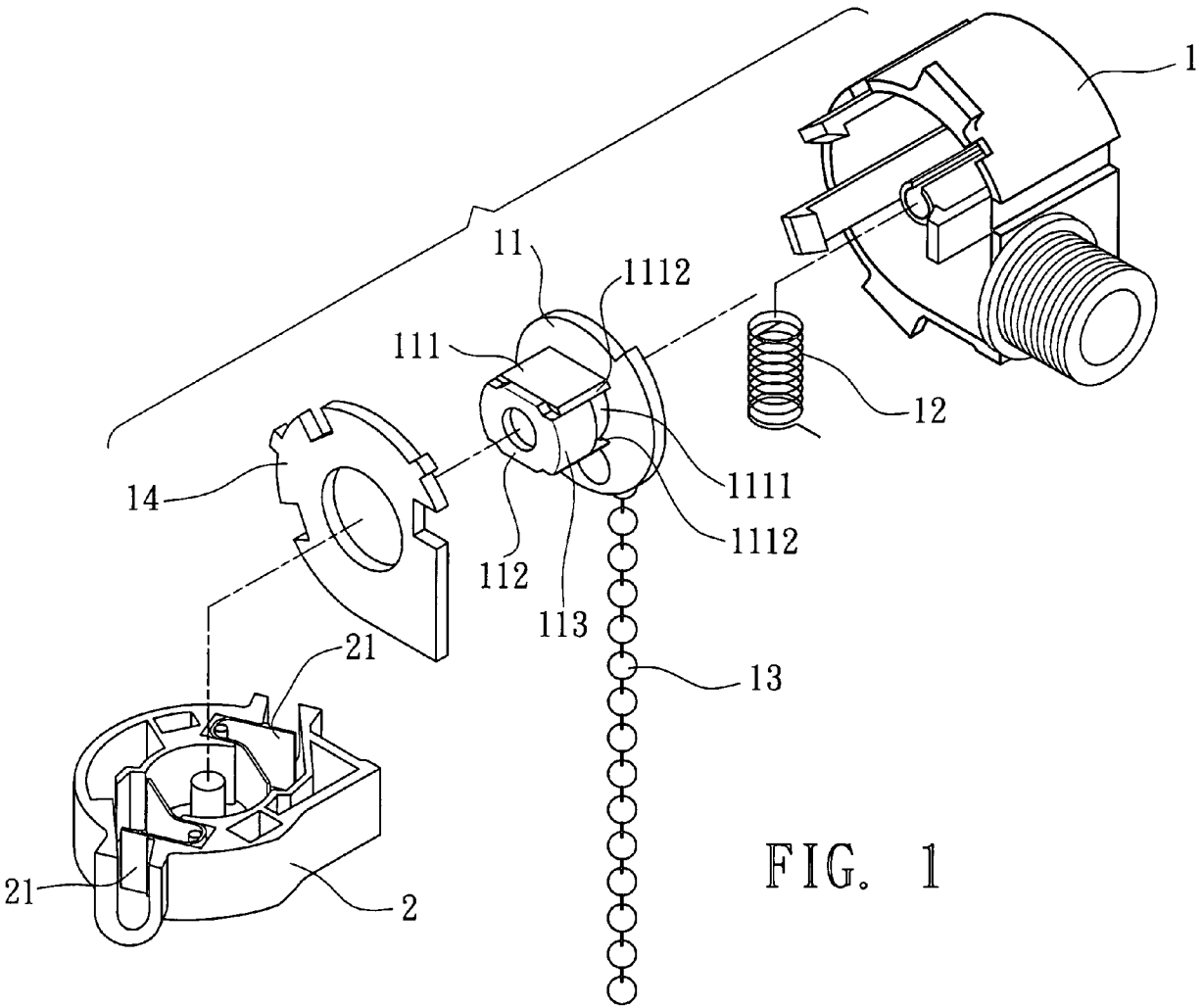
FIG. 1 is a three-dimensional exploded view of the invention.

The present invention will be apparent from the following detailed description, which proceeds with reference to the accompanying drawings, wherein the same references relate to the same elements.

In an embodiment of the invention, the zipper switch for the DC motor of a ceiling fan includes an upper shell 1 and a lower shell 2.

The upper shell 1 is pivotally disposed with an activating disk 11, an elastic element 12, a zipper 13 connected with the activating disk 1, and a pressing cover 14. One side of the activating disk 11 allows the installation of the elastic element 12 and the zipper 13. The elastic element 12 in this embodiment is a torque spring as one example. The elastic element 12 and the activating disk 11 are pivotally disposed at the center of the upper shell 1 in a concentric way. One end of the elastic element 12 urges against the activating disk 11, and the other end against the central axis of the upper shell 1. One end of the zipper 13 is connected with the activating disk 11, and the other end extends from the outer side of the upper shell 1. The activating disk 11 can be pulled by the zipper 13 to rotate in one direction, but pushed by the elastic force of the elastic element 1 to rotate in the opposite direction. One side of the activating disk 11 covers the upper shell 1 using the pressing cover 14, thereby fixing the activating disk 11. The central position on the side opposite to the zipper 13 of the activating disk has a protruding connecting part 111 that penetrates through the center of the pressing cover 14. The connecting part 111 has a long axis and a short axis. The connecting part 111 is formed with an arc-shaped groove 1111 respectively on two opposite sides of the long axis and a protruding wall 1112 on both sides of each groove 1111. The outer surface of the connecting part 111 is fixed with a metal plate 112. Each end of the metal plate 112 is formed with a wing part 113 located inside the corresponding groove 1111. Moreover, the two wing parts 113 protrude outward to combine with the protruding walls 1112. Two opposite sides of the long axis of the connecting part 111 are made into an arc shape for the convenience of rotation. Each wing part 113 has the same rotation radius. The two wing parts 113 form contacts with the two grooves 1111, respectively, so that the metal plate 112 uses the two wing parts 113 to convey an electrical current.

The lower shell 2 is connected with the upper shell 1. The central part of the lower shell 2 accommodates the connecting part 111. A conductive elastic plate 21 is disposed on both sides in the vicinity of each contact of the metal plate 112. Each conductive elastic plate 21 is connected with the corresponding wire (not shown) for providing the required electrical current when the two wing parts 113 of the metal plate 112 form contacts with the two conductive elastic plates 21.

Figure 2:
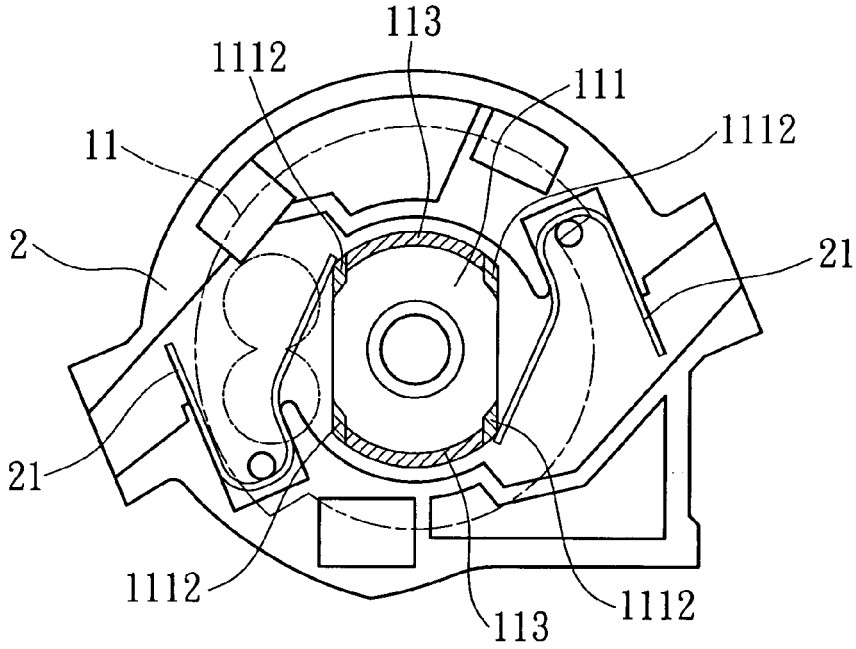
FIG. 2 is a cross-sectional view of the invention, showing the normal contact state of the metal plate.

After the upper shell 1 and the lower shell 2 are combined, wires (not shown) are connected to the corresponding conductive elastic plates 21. The zipper switch can be immediately applied to the DC motor of a ceiling fan. FIG. 2 shows its normal state. The two wing parts 113 of the metal plate 112 of the connecting part 111 do not have any contact with the two conductive elastic plates 21. That is, the two conductive elastic plates 21 are disposed in the vicinity of the corresponding contacts without any electrical current flowing through the wires.

Figure 3:
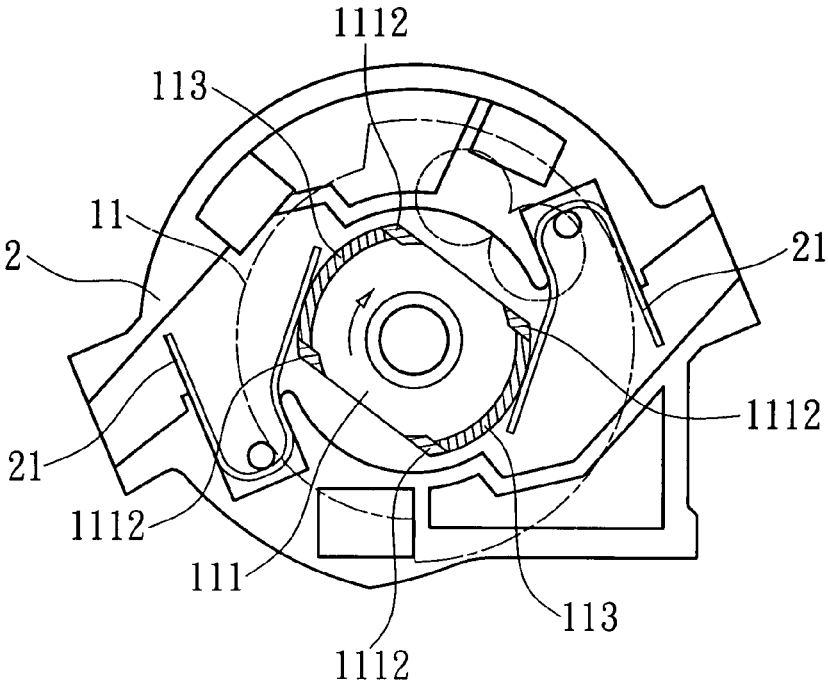
FIG. 3 is a cross-sectional view of the invention, showing the instantaneous contact state of the metal plate with the conductive elastic plates after the zipper is pulled.
Figure 4:
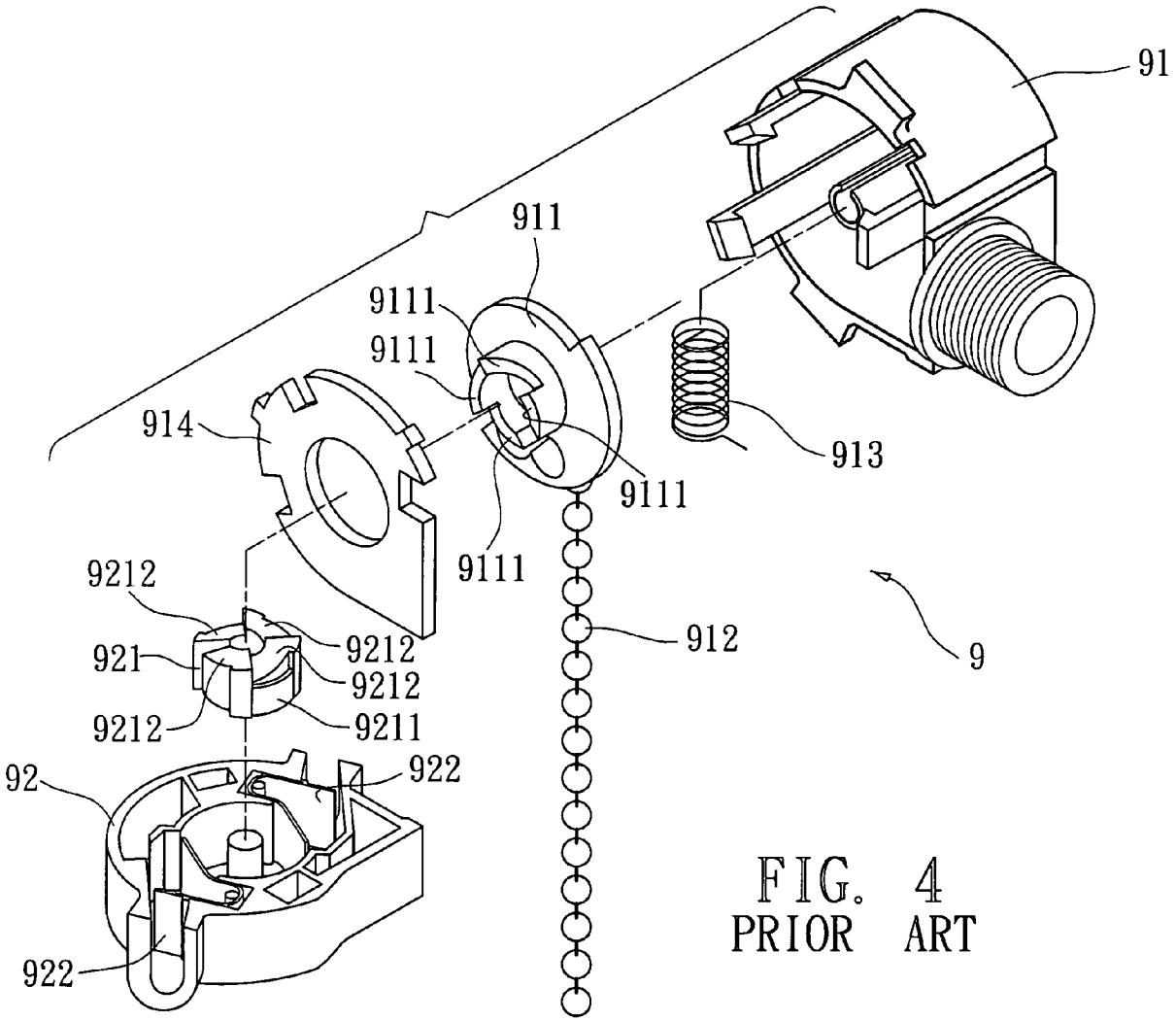
FIG. 4 PRIOR ART
FIG. 4 is the three-dimensional exploded view of a conventional zipper switch.
Figure 5:
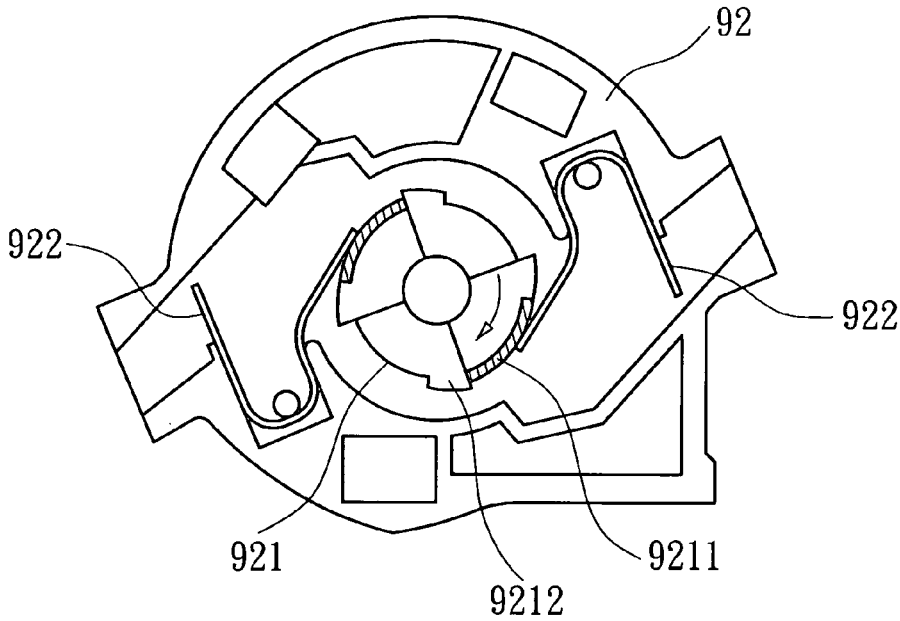
FIG. 5 PRIOR ART
FIG. 5 is a cross-sectional view of the conventional zipper switch, showing the contact state of a conductive circuit.
Figure 6:
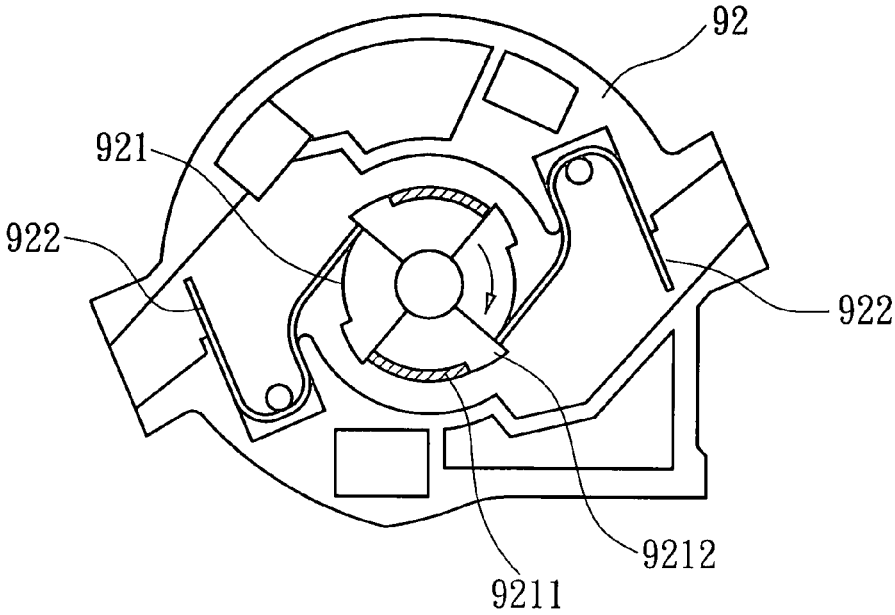
FIG. 6 PRIOR ART
FIG. 6 is a cross-sectional view of the conventional zipper switch, showing the contact state of a disconnect circuit.

To trigger and start the DC motor, as shown in FIG. 3, one pulls the zipper 13 which in turn pulls the activating disk 11 to rotate with respect to the central axis of the upper shell in one direction. This drives the connecting part 111 of the activating disk 11 and the metal plate 112 thereof to rotate at the same time. In this case, the wing parts 113 by the long axis of the connecting part 111 also rotate and have contacts with the corresponding conductive elastic plates 21 to form a conductive circuit. Since the wings 113 on both sides of the long axis of the connecting part 111 and the protruding walls 1112 have an arc shape for the convenience of rotation, the conductive elastic plates 21 can slide smoothly on the metal plate 112 as they rotate. They are not stuck at the wing parts 113 of the metal plate 112, thus forming a conductive circuit.

After the zipper 13 is released, the elastic force of the elastic element 12 pushes the activating disk 11 to rotate in the opposite direction and return to its original position. The two wing parts 113 of the metal plate 112 simultaneously depart from the two conductive elastic plates 21, forming a disconnect circuit.

By pulling and releasing the zipper, the metal plate has instantaneous contacts with the conductive elastic plates. Such an instantaneous electrical current flowing from one of the conductive elastic plate via the metal plate to the other conductive elastic plate triggers the DC motor to start.

In summary, the long axis of the connecting part of the activating disk is disposed symmetrically with a metal plate to form contacts. Pulling the activating disk to rotate produces instantaneous contacts between the metal plate and the conductive elastic plates connected with the corresponding wires. This achieves the goal of creating an instantaneous electrical current.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A zipper switch for a DC motor of a ceiling fan, comprising:

an upper shell, which is pivotally disposed with an activating disk, an elastic element, and a zipper connected with the activating disk, wherein one end of the elastic element urges against the activating disk and the other end against the upper shell, the activating disk is pulled by the zipper to rotate in one direction but pushed by an elastic force produced by the elastic element to rotate in the opposite direction, the center on one side of the activating disk has a connecting part that is disposed with a metal plate to form contacts on both sides thereof; and a lower shell, which is connected with the upper shell and whose central part accommodates the connecting part, wherein a conductive elastic plate is provided on both sides of the contacts of the metal plate so that the contacts of the metal plate rotate correspondingly to produce instantaneous contacts as the activating disk rotates.

2. The zipper switch for a DC motor of a ceiling fan of claim 1, wherein the connecting part has a long axis and a short axis and the contacts of the metal plate are located on both ends of the long axis.

3. The zipper switch for a DC motor of a ceiling fan of claim 2, wherein a groove is formed along both ends of the long axis, both ends of the metal plate are formed with a wing part in the groove, and each wing part has an arc shape and an identical rotation radius for forming the contacts.

* * * * *